US005111646A

United States Patent [19]

Lange

[11] Patent Number: 5,111,646

[45] Date of Patent: May 12, 1992

[54] TAPE WRAPPING DEVICE WITH PLURAL INDEPENDENTLY ROTATABLE SPOOL CARRIERS

[75] Inventor: Rüdiger Lange, Neuss, Fed. Rep. of Germany

[73] Assignee: Stolberger Maschinenfabrik GmbH & Co. KG, Stolberg, Fed. Rep. of Germany

[21] Appl. No.: 573,187

[22] PCT Filed: Dec. 22, 1989

[86] PCT No.: PCT/EP89/01592

§ 371 Date: Sep. 4, 1990

§ 102(e) Date: Sep. 4, 1990

[87] PCT Pub. No.: WO90/07780

PCT Pub. Date: Jul. 12, 1990

[30] Foreign Application Priority Data

Jan. 3, 1989 [DE] Fed. Rep. of Germany ..... 3900060

[51] Int. Cl.[5] ..... D02G 3/36; D07B 7/14

[52] U.S. Cl. ..... 57/15; 57/3

[58] Field of Search ..... 57/15, 3, 16, 17, 18, 57/19, 7, 22, 23

[56] References Cited

U.S. PATENT DOCUMENTS

| | | | |
|---|---|---|---|
| 1,582,026 | 4/1926 | Duclos | 57/16 X |
| 3,138,913 | 6/1964 | Haugwitz | 57/17 |
| 3,273,814 | 9/1966 | Prusak et al. | 57/3 X |
| 3,736,739 | 6/1973 | Walter | 57/19 X |
| 4,294,064 | 10/1981 | Schmitz et al. | 57/15 X |
| 4,470,248 | 9/1984 | Nortenius | 57/17 X |
| 4,628,675 | 12/1986 | Sakamoto | 57/3 |
| 4,707,214 | 11/1987 | Nithart et al. | 156/392 |
| 4,903,473 | 2/1990 | Classen et al. | 57/15 |

FOREIGN PATENT DOCUMENTS 1685843 4/1971 Fed. Rep. of Germany .

*Primary Examiner*—Daniel P. Stodola
*Assistant Examiner*—John F. Rollins
*Attorney, Agent, or Firm*—Spencer, Frank & Schneider

[57] ABSTRACT

A device for winding tape around a continuous strand of material, for example a cable, wherein two reels of tape (11, 12) are mounted on a rotating tape feed device (1) via individual reel carriers (13, 14) which rotate independently and coaxially with the strand of material, so that each empty reel of tape can be stopped, exchanged, and brought back into operation while the tape feed device (1) is still rotating. The tape can therefore be placed around the strand of material without the device being stopped. In order to change the reel of tape, it is only necessary to reduce the rotational speed of the tape feed device (1).

14 Claims, 3 Drawing Sheets

TAPE WRAPPING DEVICE WITH PLURAL INDEPENDENTLY ROTATABLE SPOOL CARRIERS

BACKGROUND OF THE INVENTION

The invention relates to a device for placing at least one tape around a continuous strand of material, particularly for putting tape around a cable, the device being provided with a driven tape feeding device for the tape which rotates about the longitudinal axis of the strand and includes a tape reel.

Continuous strands of material, particularly cables, are encased in one or two tapes of paper, plastic, metal and/or fabric made of fibers or metal wires. In many cases, the thus wound or taped strand of material is subsequently provided with an additional plastic sheath. The application of the plastic sheath is effected by way of coextrusion, that is, the taped strand of material is conducted through an appropriately configured extruder. The tape length required for taping is greater by a multiple than the length of the strand of material, so that the device as a whole must be stopped each time and held at a standstill until the empty tape reel has been exchanged (for) a full tape reel and the outgoing tape end has been connected with the incoming tape end. Since the extruder must be kept at its required temperature during the time of the standstill, the practice in the past has been to continuously draw plastic material through a discharge conduit during the period of standstill to thus prevent damage due to overheating to the plastic in the extruder itself and to the already applied plastic sheath still in the region of the extruder nozzle. Aside from the considerable losses in plastic occurring during the standstill period, there also exists the danger that, due to the influence of greater heat during the standstill period, the sheathing will be damaged.

SUMMARY OF THE INVENTION

It is the object of the invention to configure a device of the above-identified type so that continuous operation and, at the same time, an exchange of reels and the joining of the tape end and the tape beginning is possible during operation.

This is accomplished according to the invention in that at least two tape reels are provided which are each supported on a reel carrier that is mounted so as to rotate independently of the tape feeding device and coaxially with the strand of material. Each reel carrier has an associated releasable coupling so as to connect it with the tape feeding device in a manner secure against rotation and each reel carrier is provided with a device to guide the leading tape end. In such a device, the tape feeding device is composed, for example, of a rotor which rotates coaxially about the longitudinal axis of the strand and is provided with guide and tensioning elements for the tape to be applied. The rate of advance of the strand of material and the rate of rotation of the rotor are here determined by the pitch of the wound tape. Depending on the intended use, several tapes, also tapes of different materials, can be applied in one process step. In the device according to the invention, two tape reels are provided for each type of tape, with the tape always being fed from one tape reel and applied to the strand of material, while the other tape reel rotates along. When the trailing end of the tape reel in operation has left the reel, guide devices now cause the leading end of the tape from the second tape reel to be fed in and to be connected with the trailing tape end so that the taping process can be continued without stoppage. Depending on the type of connection that is employed to connect the trailing tape end with the leading tape end, the rate of advance of the strand of material, on the one hand, and the rate of rotation of the tape feeding device, on the other hand, can here be reduced over a short period of time, so that a reliable and proper connection can be effected between the outgoing trailing tape end and the incoming leading tape end. As soon as this has happened, the device is able to be brought back to its full operating speed. This has the advantage, particularly when taping strands of material, for example cables, which after the taping process are provided with a thermoplastic material by way of coextrusion, that there will be no stoppage in the region of the extruder but instead the strand of material continues to move, albeit at a reduced speed, through the extruder nozzle. By way of an appropriate control, the extrusion output of the extruder can then be reduced, while nevertheless a sheathing of uniform quality is applied to the strand of material. The discharge of surplus plastic as required when the extruder is stopped, is here completely unnecessary.

Another advantage of the invention is that the strand of material continues to move even when tapes are changed so that a considerably greater throughput is realized here compared to systems in which the machine must be stopped for a change of tapes. During or after bringing the tape feeding device to its operational rate of rotation, the coupling of the reel carrier holding the now empty tape reel is released and the reel carrier is stopped. The empty reel can now be exchanged for a full reel during operation. At the end of the exchange of reels, the reel carrier is coupled back to the rotating tape feeding device so that a full tape reel again rotates along as a reservoir reel.

As one expedient feature of the invention, the coupling is provided with a controllable start-up slip so that the associated reel carrier can be positively accelerated from a standstill to the operating rate of rotation by way of the driven tape feeding device. In this connection, it is particularly expedient for the coupling to be an electromagnetic coupling.

A further feature of the invention provides that each reel carrier is equipped with a brake to fix it relative to the machine frame. In this way, it is ensured that the reel carrier remains fixed at a standstill and cannot be carried along by residual friction forces transmitted by way of the coupling.

As a further, preferred feature it is provided that the real carriers are each equipped with a position sensor which acts with respect to the machine frame and which is connected with a control device that acts on the brake to cause the tape reel, upon application of the brake, to be put into a predetermined alignment relative to the machine frame when the real carrier is stopped. This configuration has the advantage that the reel carriers are always reliably stopped in the same orientation relative to the machine frame when the reel carriers are at a standstill so that the exchange of tape reels can also be automatized. This is done, for example, by way of corresponding supply magazines and gripping devices which, after the release of a lock, lift the empty tape reel from the reel carrier and then place a full tape reel on it. Since customarily the strand of material to be taped is guided horizontally through the machine, it is advisable to have the tape reel disposed above the strand of material whenever the reel carrier is stopped. Then it is possible to arrange transporting means for supplying full reels and removing empty reels above the taping device and to provide one or several supply magazines for full tape reels.

An advantageous feature of the invention provides that each reel carrier is equipped with at least one counterweight for the tape reel. The magnitude of the weight depends, on the one hand, on the gross weight of a full reel, that is, also on the tape material employed in each case, and is advisably designed in such a manner that the centrifugal forces generated by the counterweight and acting on the reel carrier holding a full reel, on the one hand, and those generated by the tape reel, on the other hand, are approximately compensated. If the mass of the counterweight is designed to be somewhat smaller than the mass of a full tape reel, the remaining imbalance with a full reel, on the one hand, and a completely or almost completely empty reel, on the other hand, still remains within permissible limits since after transfer of the tape end from a full reel, the tape feeding device is accelerated from a low rate of rotation to a high operating rate of rotation and quantities of tape are already being removed during this acceleration phase. As soon as the tape reel in operation has a predetermined amount of tape left, the rate of rotation of the tape feeding device is again reduced so that the imbalance now caused by the greater mass of the counterweight can again be tolerated in view of the decreasing rate of rotation.

A preferred feature of the invention provides that a two-part counterweight is disposed at each reel carrier and the two partial weights are preferably mounted so that during operation they can be adjusted relative to one another circumferentially in opposite directions by means of an adjustment drive. This arrangement has the advantage that, by appropriately displacing the partial weights relative to one another, the counterweight can be set for any desired reel weight, thus making it possible to process different tape materials without it being necessary to exchange the counterweights or add or remove additional weights. A particular advantage of this arrangement is that, if an appropriately configured adjustment drive is provided, the partial weights can be adjusted relative to one another during operation corresponding to the decrease in reel weight. In this way, the rotor formed by the reel carrier, the reel and the counterweight can always be kept in balance, and thus practically at the operating rate of rotation during the entire "trip" of a tape reel. The start-up time from the slow rate of rotation to the operating rate of rotation once a tape reel is put into operation and the braking time to the low rate of rotation required during the time in which the trailing tape end is connected to the leading tape end of the next tape reel can here also be reduced. Another particular advantage is that, when the two partial weights are adjusted by rotating them about the axis of rotation of the reel carrier, even centrifugal forces do not cause the partial weights to be displaced so that the adjustment forces required for continuous adjustment need be only of such magnitude that the friction of the bearings for the partial weights and, in the acceleration phase, the accelerating forces of the partial weights in the circumferential direction need be overcome. Since, however, in this embodiment the tape feeding device can be brought up very quickly to a then constant operating rate of rotation, it is possible to effect continuous adjustment without force until the system is braked shortly before the end of the tape since the partial weights are subjected to practically no mass acceleration in the circumferential direction.

As a further advantageous feature of the invention, it is provided that the tape feeding device is equipped with a tape supply arm and includes a positioning device which acts on the coupling by way of a control device so that, in the operating position, each tape reel is held in a predetermined orientation relative to the tape supply arm. The positioning device is here advisably configured so that the two reels are oriented diametrally to one another. Thus, after the exchange of an empty tape reel for a full tape reel, the positioning device is able to act on the coupling control to position the reel carrier so as to cause the guiding device of the reel carrier holding the new, full tape reel to be positioned precisely on the tape supply arm so that, when a "tape end" signal for the reel in operation is generated, the leading tape end can be supplied to the tape supply arm to be connected with the outgoing tape end.

As a further feature of the invention, it is provided that each reel carrier is equipped with a driven tape guide which drives the tape and/or the reel at least when the leading end of the tape is threaded into the tape supply arm. In this way it is possible to accelerate the incoming leading tape end to the speed of the outgoing tape end so that both tapes move at the same speed at the moment when the trailing tape end and the leading tape end must be connected together while, at the end of the connection process, the newly incoming tape continues without jerks. This has the particular advantage that the connection of the trailing tape end and the leading tape end is practically not stressed at all with tension so that the requirements placed on the strength of the connection can be kept low. As soon as the tape has been applied to the strand of material to be taped, the leading tape end and the trailing tape end are held firmly in any case because of the overlap.

As a further feature of the invention, it is provided that the tape feeding device is equipped with a signal generator for the "tape end" signal in response to which the control device switches on the respective tape guiding drive for the full tape reel. An appropriate control device then not only effects synchronism of the trailing tape end and the leading tape end but simultaneously it also determines the time and location at which the trailing tape end and the leading tape end can be connected with one another.

As a further feature of the invention it is provided that the tape feeding device is equipped, preferably in the region of the tape supply arm, with a tacking device which connects the outgoing end of the one tape with the incoming end of the other tape. The term "tacking device" in the sense of the present invention relates to all devices with which the tape end and the tape leader can be connected with one another. The configuration and mode of operation depend, for example, also on the tape material employed. For example, paper tapes can be connected with one another in a simple pressing process if the tape leader and the tape end are given a coating of a so-called molecular adhesive. The tacking device, however, may also include a glue application device in addition to the pressing device. If tapes made of a thermoplastic material are being processed, the connection may be made by welding them together under the influence of heat, radiation or also ultrasound. For metal tapes, the tacking device may be configured, for example, as a dot welding device. However, this requires either a "flying" welding device or an additional tape drive must be provided for each tape reel to make it possible to move by appropriate acceleration at least the outgoing tape end into a "reserve loop" so that the standstill period required for a welding process is available at the welding location while, nevertheless, the tape feeding device continues to rotate and the previously formed "reserve loop" is reduced again. For metal tapes, particularly steel tapes, it is advisable, because of their much greater strength, to perform the joining of the trailing tape end and the leading tape end by way of a stamping-embossing process so that both tapes are hooked into one another by way of a form-locking connection and can be stressed with tension.

Another advisable feature of the invention provides that the tape supply arm is tubular at least in the region where the tape makes first contact with the strand of material. In this way, it is prevented that, at the high rate of rotation, the incoming tape is twisted due to wind resistance or is caused to vibrate. Advisably, at least part of the tubular region is made of a transparent material.

As a further feature of the invention it is provided that a sensor for the centrifugal force acting on the reel body is disposed in each tape reel. This sensor acts by way of a control device on the rotary drive of the tape feeding device and on the drive effecting the passage of the strand of material so that the rate of rotation for the tape feeding device and the removal rate of the strand of material is varied as a function of a predeterminable constant value for the centrifugal force. The ratio of the rate of rotation of the tape feeding device to the removal rate for the strand of material is kept constant to correspond to the predetermined taping pitch. This arrangement makes it possible to initially operate with a lower operating rate of rotation when the reels are full and then to increase the rate of rotation of the tape feeding device as the coil diameter continues to decrease. The centrifugal force acting on the respective reel body in operation is here a measure for the decrease in coil diameter and constitutes the reference value according to which the rate of rotation and the removal rate are regulated. Thus it is possible to operate the taping device always in an optimum rate of rotation range. After a starting rate of rotation determined by the given centrifugal force, a progressive rise develops for the remaining period of operation up to the maximum permitted rate of rotation which can be maintained until the end when the device must be braked again to lower rotation rates in order to enable the outgoing tape end to be connected with the incoming tape end. As a whole, it is thus possible to realize a considerable increase in production with improved quality.

As another advantageous feature of the invention it is provided that a sensor for the centrifugal force acting on the reel bodies is provided on each tape reel and acts by way of a control device on an adjustment drive for the mutually displaceable partial counterweights. This arrangement has the advantage that the taping device can be operated practically without imbalances since, on the one hand, the full supply reel is fully balanced and is fixed to the tape feeding device by way of its coupling. The tape reel in operation, which is also fixed with the tape feeding device by way of its coupling is likewise fully balanced since with decreasing reel weight the two parts of the counterweight are displaced from one another about the circumference of the reel carrier so that, in this way, the reduction in weight of the tape reel is compensated continuously.

BRIEF DESCRIPTION OF THE DRAWINGS

The invention will now be described in greater detail with reference to schematic representations of embodiments thereof, wherein.

DESCRIPTION OF THE PREFERRED EMBODIMENTS

Figure 1:
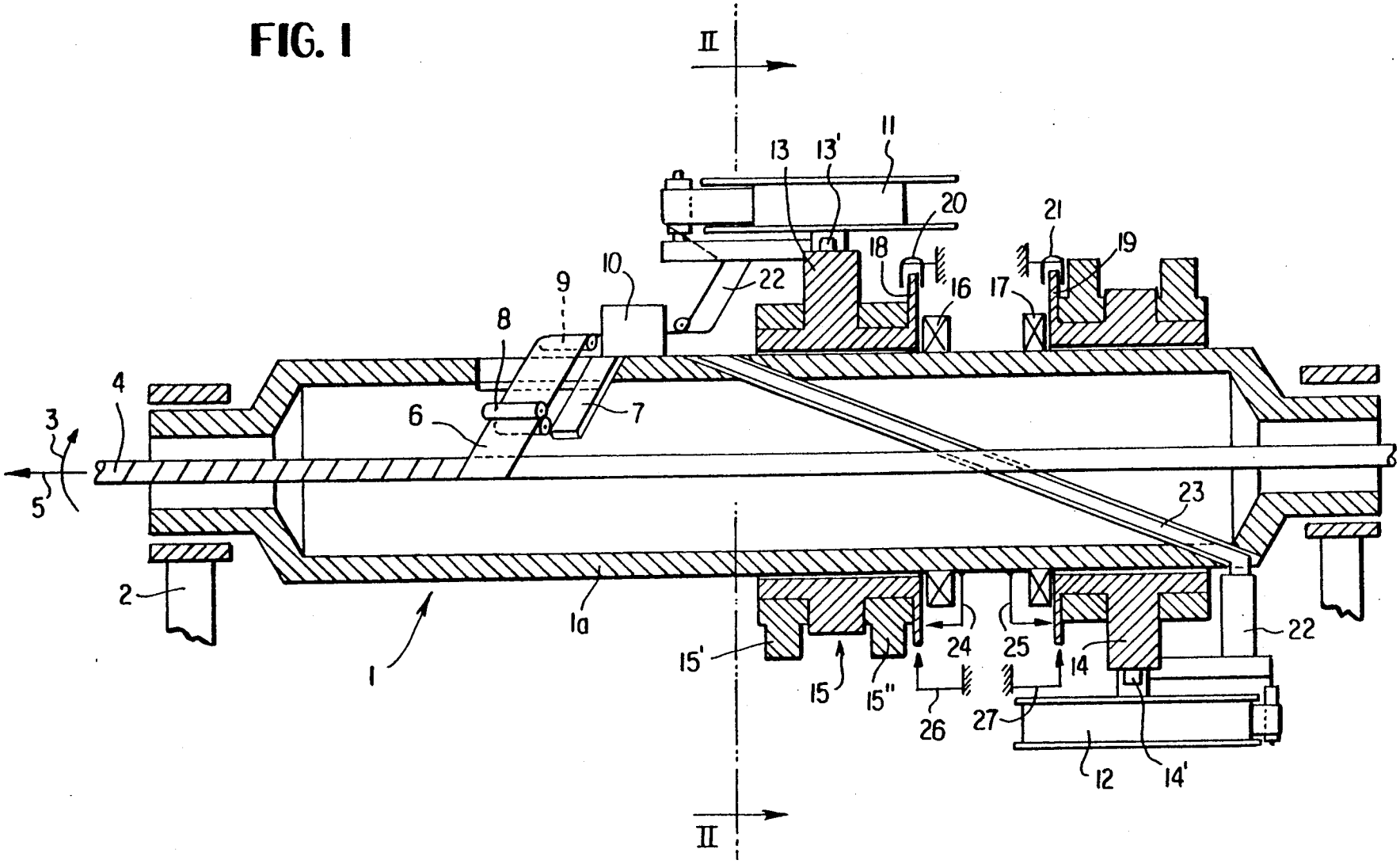
FIG. 1 is a schematic longitudinal sectional view of a device for placing tape around a cable.

The taping device shown schematically in FIG. 1 includes a tape feeding device 1 having a hollow housing 1*a* which is rotatably mounted in a machine frame 2 and is driven by way of a drive (not shown in detail) in the direction of an arrow 3. A strand of material 4, for example a cable, is guided coaxially with its axis of rotation through the housing 1*a* of tape feeding device 1 in the direction of an arrow 5. The rate of advance of strand of material 4, on the one hand, and the rotational velocity of the tape feeding device, on the other hand, are matched with one another in such a way that a tape 6 coming in by way of tape feeding device 1 is wound around the strand of material at the pitch resulting from the ratio of the rate of advance of the strand of material to the rate of rotation of the tape feeding device. The device is guided in such a manner that the windings are made with overlaps. In addition to fabrics of natural and synthetic fiber material and/or wires, tapes made of non-woven materials, plastic or metal foils including steel tapes are also suitable as material for tape 6.

Tape feeding device 1 is connected with a tape supply arm 7 which is provided with guiding devices 8, 9 in the form of guide fingers, rollers or the like. For automatic operation, the tape supply arm in the illustrated embodiment is additionally provided with a tacking device 10 which makes it possible to firmly connect the trailing end of the tape coming from a tape reel 11 with the incoming leading end of the tape from another tape reel 12 so that the taping process can continue without interruption. The type of the tacking device here depends on the material employed and if, for example, tapes of paper or plastic are employed, may be a gluing device. For plastics, a configuration using a welding device is also possible, while for metal tapes a mechanical connection by means of a stamping-embossing device is advisable.

The two tape reels 11 and 12 are each arranged separately on a reel carrier 13 and 14, with both reel carriers being mounted on the tape feeding device so as to rotate independently of one another. Reel carrier 13 as well as reel carrier 14 are provided with a counterweight 15 on their sides facing away from tape reels 11 and 12, respectively. In the illustrated embodiment, this counterweight is divided into two partial weights 15' and 15'', with the two partial weights, in turn, being mounted on the reel carrier so as to be rotatable in mutually opposite directions relative to the axis of rotation. Each one of the two reel carries 13 and 14 has an associated controllable coupling 16 and 17 which is configured, for example, as an electromagnetic coupling and by means of which the two reel carriers can be connected independently of one another with the rotating tape feeding device in a manner secure against rotation.

Moreover, reel carriers 13 and 14 are each provided with a braking device, for example in the form of a brake disk 18 and 19, with which is associated a corresponding brake caliper 20 and 21 at the machine frame 2 so that, after release of coupling 16 or 17, reel carrier 13 or 14, respectively, can be fixed with respect to machine frame 2.

Reel carriers 13 and 14 are additionally each provided with a (guiding device 22) which may be provided, if required, with a drive (not shown here) so that the leading end of the tape of each reel can be introduced into the tape supply arm. Guiding device 22 of reel 12 has an associated (tape transfer member 23) which is fastened to the rotating tape feeding device and with which the respective beqinning of a tape can be advanced to the tape supply arm 7 in the region of tacking device 10.

In operation, reel carriers 13 and 14 are each provided with a full tape reel, with tape 6 from only one tape reel, for example tape reel 11, being applied to strand of material 4 by way of tape supply arm 7. Both reel carriers are connected with tape feeding device 1 in a manner secure against rotation by way of their couplings 16 and 17, with the alignment of guiding device 22 relative to tape supply arm 7 and tape transfer member 23 being effected by means of positioning devices 24 and 25, respectively. The function and operation of positioning devices 24 and 25 will be described in greater detail below.

Each reel carrier is additionally connected with a respective signal generator, shown schematically at 13' and 14 which initiates a "tape end" signal as soon as, for example, only a predetermined length remains on reel 11 presently in operation. This signal generator then switches on a drive at guiding device 22 for tape reel 12 which introduces the leading end of its tape into tacking device 10 at the moment when the trailing end of the tape from reel 11 passes through tacking device 10 so that the tape end and the tape beginning can be connected with one another, thus applying an "endless tape" to strand of material 4.

In order for this changing process to take place reliably and without malfunction, the above-mentioned signal generator reduces the rate of rotation of the tape feeding device so that this process takes place while the entire system moves at a "creeping pace". As soon as the tacking process has taken place and the tape comes from reel 12, the system is switched back to its operational rate of rotation. During this process, coupling 16 of reel carrier 13 carrying the empty tape reel 11 is already being released and simultaneously brake 18, 20 is actuated so that reel carrier 13 can be stopped at machine frame 2. By way of a positioning device 26 associated with the machine frame and in cooperation between the controllable coupling and the brake, it is accomplished that reel carrier 13 is stopped in a predetermined position relative to the machine frame. Now a reel lock of conventional configuration and known in connection with cabling machines is released so that the empty tape reel 11 can be removed and replaced by a full tape reel. This reel changing process advisably takes place by way of an automatically controlled reel changing device.

As soon as reel carrier 13 has been provided with a full tape reel, brake 18, 20 is released and simultaneously coupling 16 is activated by means of a corresponding start-up control so that reel carrier 13 is carried along by the tape feeding device which already rotates at the operating rate of rotation and is accelerated to the operating rate of rotation. The positioning device 24 associated with the rotating tape feeding device now fixes reel carrier 13, by way of actuation of the coupling, in its original position associated with tape supply arm 7 so that again both reel carriers 13 and 14 rotate together with tape feeding device 1 as a compact unit. As soon as the signal generator of tape reel 12 initiates the "tape end" signal, the above-described reel changing process takes place in a corresponding manner for reel carrier 14 which is likewise stopped in a precise position by a positioning device associated with the machine frame.

Figure 2:
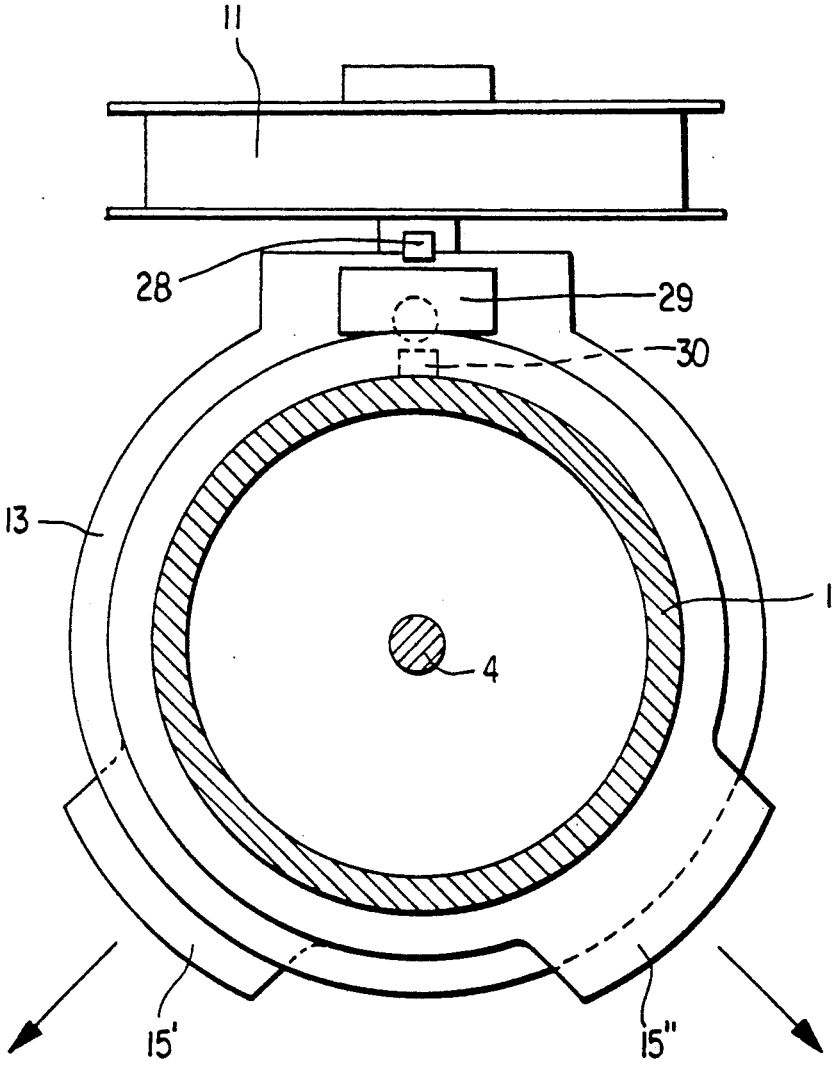
FIG. 2 is a sectional view along line II—II of FIG. 1.

FIG. 2 is a sectional view of the structure and shows operation of the divided counterweights 15' and 15''. As can be seen in FIG. 1, each partial weight 15' and 15'' is seated on its own guide ring on reel carrier 13 so as to rotate coaxially with the passing strand of material 4. The appropriate adjustment of the two partial weights relative to one another then compensates for the weight of tape reel 11 and 12, respectively, so that the two reel carriers each constitute a rotor which is balanced in itself.

Each one of tape reels 11 and 12 has its associated centrifugal force sensor 28 which is connected with an (adjustment drive 29) for the two partial weights 15' and 15''. The two partial weights 15' and 15'' also have an associated 'common centrifugal force sensor 30 which detects the compensating centrifugal force of the partial weights resulting from the displacement angle of the two partial weights relative to one another. This sensor is also connected with the adjustment drive so that each reel carrier is automatically balanced. If now tape is removed continuously from the tape reel, the centrifugal force acting on sensor 28 goes down. The difference now resulting from the generated compensatory centrifugal force is equalized by way of adjustment drive 29 in that it correspondingly increases the displacement angle between the two partial weights 15' and 15''. The design of the adjustment drive must merely consider that tangential accelerations acting on counterweights 15' and 15'' are absorbed.

Figure 3:
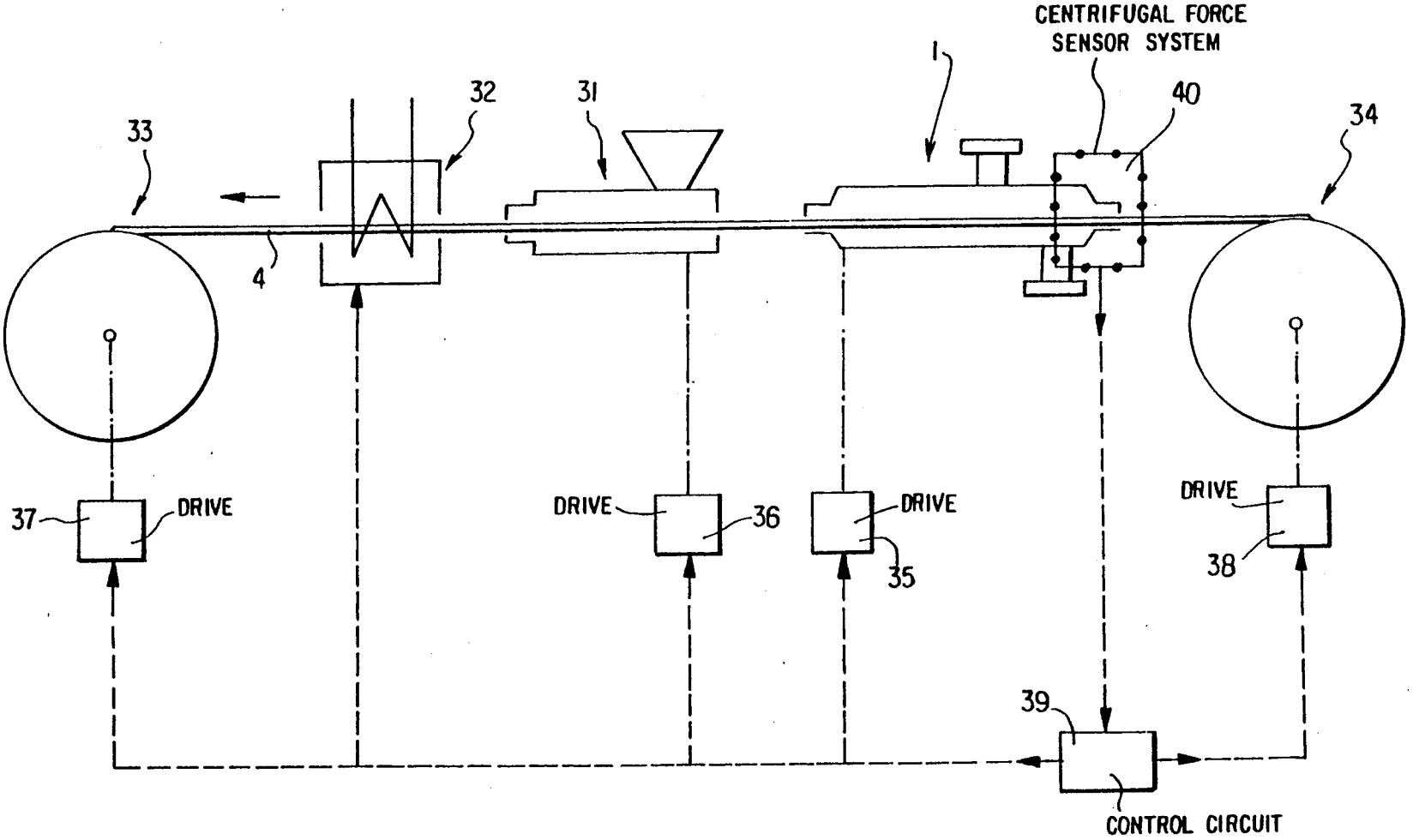
FIG. 3 schematically illustrates a system for the regulation of a taping, system and includes a block circuit diagram.

FIG. 3 shows, in the form of a block circuit diagram, a tape applying system in which the strand of material 4 to be wound with tape is additionally provided, after the application of the tape, with a protective sheath of a thermoplastic material that is applied in a coextrusion process. The individual devices are indicated only symbolically, with the drives being shown separately to provide for better understanding of the control.

The system is essentially composed of a tape applying device represented by its tape feeding device 1, an extruder 31 which has an associated cooling device 32 and a winding device 33. The strand of material 4 to be taped and provided with a protective sheath is supplied by way of an unwinding station 34. Drive 35 for the taping device, drive 36 for the extruder, drive 37 for the winding device as well as drive 38 for the unwinding device are now linked with one another by way of a control circuit 39, with the linkage being predetermined by the desired pitch ratio of the taping on the strand of material, that is, by the ratio of the rate of advance of the strand of material to the rate of rotation of the tape feeding device. This value is a fixed given value so that all drives are adjusted to it. By way of the control of drive 36 for extruder 31, the control of extruder 31 is additionally actuated in the conventional manner. The centrifugal force sensor system of taping device 1 is indicated by the dash-dot frame 40. This system provides the reference value for the control.

Since, as described above, each tape reel has an associated centrifugal force sensor, it is possible with this linkage of all drives to realize an even further increase in performance of the system. With increasing reduction of the weight of the tape reel presently in operation, the mass moment of inertia of the rotor composed of the tape feeding device and the two reel carriers is also reduced so that the rate of rotation of the tape feeding device can be increased in each case, thus permitting operation of the tape applying device always in the optimum rate of rotation range. After a change of reels, that is, the connection of an outgoing trailing tape end with the incoming leading tape end, the system is initially operated at a "creeping pace" at a starting rate of rotation which is determined by a predetermined centrifugal force. Then there results for the remaining quantity on the reel a progressive rise in the rate of rotation until the maximum permissible rate of rotation is reached which can be maintained until the respective signal generator initiates the "tape end" signal for the reel presently in operation and the machine is returned to the "creeping pace". As a whole, it is possible to realize a considerable increase in production in this way.

The arrangement of the tape reels and their radially oriented reel axes as shown in FIG. 1 is particularly advisable because this not only facilitates the exchange of reels but also renders it possible to employ tape reels which have a large diameter, while simultaneously keeping the radius of the reel carrier (which determines the mass moment of inertia) small. However, the axes of the tape reels may also be oriented parallel or at an angle to the axis of rotation on the tape feeding device. For a multi-layer tape application in only a single machine, two additional reel carriers must then be provided in each case to correspond to the number of layers. If the axis of rotation is horizontal and the reel disposed at the top is exchanged, the counterweight 15 now at the bottom then has a stabilizing effect once the tape reel is released from the reel carrier.

What I claim is:

1. A device for helically taping a continuous strand of material having a segment which extends along a straight path, the straight segment of the strand having a longitudinal axis, comprising:

a machine frame;

a hollow housing through which the straight segment of the strand extends, the housing being mounted on the machine frame for rotation about the longitudinal axis of the straight segment;

first reel means for holding a first tape having a beginning end;

first reel carrier means, on which the first reel means is mounted, for moving the first reel means along a path that encircles the longitudinal axis of the straight segment of the strand, the first reel carrier means being rotatable with respect to the housing;

first guiding device means for guiding the beginning end of the first tape;

first releasable coupling means for selectively coupling the first reel carrier means to the housing so that the first reel carrier means and the housing are rotatable in unison;

first brake means for selectively fixing the first reel carrier means with respect to the machine frame;

second reel means for holding a second tape having a beginning end;

second reel carrier means, on which the second reel means is mounted, for moving the second reel means along a path that encircles the longitudinal axis of the straight segment of the strand, the second reel carrier means being rotatable with respect to the housing;

second guiding device means for guiding the beginning end of the second tape;

second releasable coupling means for selectively coupling the second reel carrier means to the housing so that the second reel carrier means and the housing are rotatable in unison.

second brake means for selectively fixing the second reel carrier means with respect to the machine frame; and wherein the first and second releasable coupling means and the first and second brake means are selectively operable during rotation of the housing to permit a depleted reel means to be replaced while the device continues helically taping the strand.

2. A device according to claim 1, wherein the first coupling means comprises means for providing a controllable start-up slip, and wherein the second coupling means comprises means for providing a controllable start-up slip.

3. A device according to claim 1, wherein the first coupling means is configured as an electromagnetic coupling, and wherein the second coupling means is configured as an electromagnetic coupling.

4. A device according to claim 1, further comprising first position sensor means for sensing the position of the first reel carrier means relative to the machine frame, second position sensor means for sensing the position of the second reel carrier means relative to the machine frame, and control device means, responsive to signals from the first and second position sensor means, for selectively actuating the first and second brake means so as to effect, upon application of one of the brake means, a predetermined orientation of the respective reel means relative to the machine frame when the respective reel carrier means is at a standstill.

5. A device according to claim 4, wherein the straight segment of the strand of material is horizontally disposed and wherein, when one of the reel carrier means is stopped, the respective reel means is disposed above the straight segment of the strand of material.

6. A device according to claim 1, wherein the first reel carrier means is provided with at least one counterweight for the first reel means, and the second reel carrier means is provided with at least one counterweight for the second reel means.

7. A device according to claim 6, wherein each counterweight respectively comprises two partial weights which are mounted so as to be adjustable in the circumferential direction and in opposite directions relative to one another, and further comprising adjustment drive means for adjusting the two partial weights of each counterweight.

8. A device according to claim 7, further comprising first centrifugal force sensor means for the centrifugal force acting on the first reel means and second centrifugal force sensor means for sensing the centrifugal force acting on the second reel means, and wherein the adjustment drive means is responsive to signals from the first and second centrifugal force sensor means.

9. A device according to claim 1, further comprising tape supply arm means, mounted on the housing, for directing tape toward the strand of material, first positioning detector device means for detecting the position of the first reel carrier means relative to the housing, second positioning detector device means for detecting the position of the second reel carrier means relative to the housing, and control means, responsive to signals from the first and second positioning detector device means, for selectively actuating the first and second releasable coupling means so that, in the operational position, both reel means are held in a predetermined orientation relative to the tape supply arm means.

10. A device according to claim 9, wherein each reel carrier means is provided with a respective driven tape guide which drives the respective tape at least while the beginning end of the respective tape is being threaded into the tape supply arm means.

11. A device according to claim 10, further comprising tape-end signal generator means for generating a signal, when the tape held by one reel means is depleted, to actuate the driven tape guide for the reel carrier means on which the other reel means is mounted.

12. A device according to claim 11, wherein the first and second tapes additionally have terminating ends, and further comprising tacking device means for connecting the terminating end of one tape with the beginning end of the other tape.

13. A device according to claim 9, wherein the tape supply arm means has a tubular configuration at least in the region where the tape starts to come in contact with the strand of material.

14. A device according to claim 1, further comprising drive means for rotating the housing, additional drive means for moving the strand of material along the path, and centrifugal force sensor means for sensing the centrifugal force acting on each reel means, and control means, responsive to the centrifugal force sensor means, for controlling the drive means and the additional drive means so that the rate of rotation of the housing and the rate that the strand of material moves along the path are varied as a function of a predetermined constant value for the centrifugal force, with the ratio of the rate of rotation of the housing to the rate that the strand material moves along the path being kept constant corresponding to a predetermined helical taping pitch.

* * * * *